US010652644B2

(12) United States Patent
Bruss et al.

(10) Patent No.: US 10,652,644 B2
(45) Date of Patent: May 12, 2020

(54) EAR TIP DESIGNED TO ENABLE IN-EAR DETECT WITH PRESSURE CHANGE IN ACOUSTIC VOLUME

(71) Applicant: APPLE INC., Cupertino, CA (US)

(72) Inventors: John R. Bruss, Culver City, CA (US); Duy P. Le, Los Angeles, CA (US); Sean S. Corbin, San Jose, CA (US); Robert A. Boyd, Los Angeles, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 16/272,982

(22) Filed: Feb. 11, 2019

(65) Prior Publication Data

US 2020/0100011 A1 Mar. 26, 2020

Related U.S. Application Data

(60) Provisional application No. 62/733,830, filed on Sep. 20, 2018.

(51) Int. Cl.
*H04R 1/00* (2006.01)
*H04R 1/10* (2006.01)

(52) U.S. Cl.
CPC ..... *H04R 1/1016* (2013.01); *H04R 1/105* (2013.01); *H04R 1/1066* (2013.01); *H04R 2420/07* (2013.01)

(58) Field of Classification Search
CPC .. H04R 1/1016; H04R 1/1058; H04R 1/1075; H04R 1/1083; H04R 25/652; H04R 1/1066; H04R 25/65; H04R 25/656; H04R 2460/15; H04R 2225/77
See application file for complete search history.

(56) References Cited

U.S. PATENT DOCUMENTS

| | | | | |
|---|---|---|---|---|
| 8,165,332 | B2 * | 4/2012 | Giese | H04R 25/456 381/328 |
| 8,189,846 | B2 * | 5/2012 | Tiscareno | H04R 1/1016 381/322 |
| 8,573,353 | B2 * | 11/2013 | Mulvey | A61F 11/08 181/130 |
| 8,848,964 | B2 * | 9/2014 | Erdel | H04R 1/1091 381/338 |
| 9,955,247 | B2 | 4/2018 | Huwe et al. | |
| 10,129,625 | B2 | 11/2018 | Huwe et al. | |
| 10,219,064 | B1 * | 2/2019 | Valenzuela | H04R 1/30 |
| 10,334,375 | B2 * | 6/2019 | Naether | H04R 25/658 |
| 10,542,341 | B2 * | 1/2020 | Higgins | H04R 1/1016 |

(Continued)

*Primary Examiner* — Matthew A Eason
(74) *Attorney, Agent, or Firm* — Kilpatrick Townsend & Stockton LLP

(57) ABSTRACT

An earbud tip for an in-ear headphone can include an outer body; an inner tube extending at least partially within the outer body, the tube having opposing first and second ends and first and second openings at the opposing first and second ends, respectively, the first opening configured to emit audio signals provided by a speaker of an in-ear headphone into a user's ear canal during operation of the in-ear headphone and when the earbud tip seals the user's ear canal and the second opening configured to be removably coupled to a portion of the in-ear headphone; and one or more channels extending from an outer periphery of the earbud tip to the inner tube.

21 Claims, 5 Drawing Sheets

(56) References Cited

U.S. PATENT DOCUMENTS

| | | | | |
|---|---|---|---|---|
| 2006/0045304 | A1* | 3/2006 | Lee | H04R 1/1041 381/384 |
| 2009/0103764 | A1* | 4/2009 | Stiehl | B29C 45/0025 381/380 |
| 2011/0176700 | A1* | 7/2011 | Hashimoto | H04R 1/1016 381/380 |
| 2011/0268308 | A1* | 11/2011 | Vasquez | H04R 1/1016 381/380 |
| 2012/0243725 | A1* | 9/2012 | Takai | H04R 1/1016 381/380 |
| 2012/0243726 | A1* | 9/2012 | Hosoo | H04R 1/1016 381/380 |
| 2012/0244812 | A1* | 9/2012 | Rosener | H04M 1/6066 455/41.3 |
| 2013/0188819 | A1* | 7/2013 | Young-Mun | H04R 25/652 381/380 |
| 2014/0138179 | A1* | 5/2014 | Burton | H04R 1/1016 181/135 |
| 2015/0023510 | A1* | 1/2015 | Shimizu | H04R 29/00 381/58 |
| 2016/0057551 | A1* | 2/2016 | Higgins | H04R 25/60 381/328 |
| 2016/0066110 | A1* | 3/2016 | Shennib | H04R 25/652 381/328 |
| 2018/0070165 | A1 | 3/2018 | Hatfield et al. | |
| 2019/0166438 | A1* | 5/2019 | Perkins | H04R 25/652 |

* cited by examiner

EAR TIP DESIGNED TO ENABLE IN-EAR DETECT WITH PRESSURE CHANGE IN ACOUSTIC VOLUME

CROSS-REFERENCES TO RELATED APPLICATIONS

This application claims the benefit of U.S. Provisional Application No. 62/733,830, filed Sep. 20, 2018, entitled "EAR TIP DESIGNED TO ENABLE IN-EAR DETECT WITH PRESSURE CHANGE IN ACOUSTIC VOLUME" the disclosure of which is incorporated by reference herein in its entirety.

FIELD

The described embodiments relate generally to electronic devices and accessories such as in-ear headphones and earbud tips for the in-ear headphones designed to enable in-ear detect with pressure change in acoustic volume.

BACKGROUND

Accessories such as in-ear headphones are often used with electronic devices such as media players, cellular telephones, or tablets. Such in-ear headphones are often provided with sensors and control circuitry. These features allow the in-ear headphones to enable in-ear detection of the headphone when in or near a user's ear canal. This allows the in-ear headphones or electronic device to activate media playback, resume media playback, restore volume level of media playback, or activate noise cancelling in response to the in-ear detection. Similarly, media playback can be deactivated, paused, stopped, volume minimized, or noise cancelling deactivated in response to the in-ear headphones being removed from or positioned out of the user's ear canal. Such in-ear detection capability can be falsely triggered by ear-wax, dead skin, or other debris build up blocking sensors or sealing of an earbud tip outside the user's ear canal (e.g., when positioned against a planar surface or a user's clothing pocket, within an enclosure, or when blocked by a user's hands or fingers). This can lead to unnecessary power consumption or unintentional media playback by the electronic device or in-ear headphone.

Thus, there remains a need for accessories such as in-ear headphones with features and components designed or configured to enable in-ear detection while reducing, minimizing, or preventing false triggering of the in-ear detection system.

BRIEF SUMMARY

Some embodiments of the present invention relate to electronic accessories such as in-ear headphones along with features and components designed or configured to enable in-ear detection while reducing, minimizing, or preventing false triggering of the in-ear detection system. Some embodiments pertain to an earbud tip for an in-ear headphone. The earbud tip can include an outer body and an inner tube extending at least partially within the outer body. The tube can include opposing first and second ends and first and second openings at the opposing first and second ends, respectively. The first opening can be configured to emit audio signals provided by a speaker of an in-ear headphone into a user's ear canal during operation of the in-ear headphone and when the earbud tip seals the user's ear canal and the second opening can be configured to be removably coupled to a portion of the in-ear headphone. The earbud tip can further include one or more channels extending from an outer periphery of the earbud tip to the inner tube. The channels can prevent or reduce a potential of unintentionally sealing the earbud tip to a surface other than a user's ear canal as described herein.

In some embodiments, the one or more channels of the earbud tip include one or more vents extending through the outer periphery of the earbud tip and in fluid communication with the inner tube. In other embodiments the one or more channels can include at least one or more grooves, divots, depressions, recesses, or dimples at the exterior surface of the outer body such that the exterior surface includes a plurality of valleys between adjacent peaks and disposed radially around the first opening at its distal end.

In some embodiments, the one or more channels extend across a top surface of the earbud tip from the outer periphery to the first opening of the earbud tip. The one or more channels can be formed on a rim of the earbud tip extending circumferentially around the first opening. The one or more channels are configured to deter unintentional sealing of the earbud tip against a planar surface outside the ear canal. The one or more channels are configured to deter unintentional sealing of the earbud tip against clothing of the user.

Some embodiments of the present invention relate to an earbud tip for an in-ear headphone. The earbud tip includes an outer body and an inner tube extending at least partially within the outer body, the tube having opposing first and second ends and first and second openings at the opposing first and second ends, respectively. The first opening is configured to emit audio signals provided by a speaker of an in-ear headphone into a user's ear canal during operation of the in-ear headphone and when the earbud tip seals the user's ear canal and the second opening is configured to be removably coupled to a portion of the in-ear headphone. The earbud tip includes one or more channels one or more channels arranged radially around the first opening and extending through the outer periphery of the earbud tip to the inner tube In some embodiments, in-ear headphones are provided. The in-ear headphones can include a first earbud including a housing, a speaker positioned within the housing, a conduit at least partially enclosed by the housing configured to direct audio signals provided by the speaker into an ear canal of a user, and an earbud tip, as described herein, coupleable to a portion of the conduit and configured to seal the ear canal of the user when positioned therein.

In some embodiments, the in-ear headphone further includes one or more ear presence sensors configured to detect when the earbud tip is located near or in the user's ear canal. The one or more ear presence sensors can include at least one of a force sensor, mechanical sensor, capacitive sensor, resistance-based sensor, light-based sensor, accelerometer-based sensor, acoustic-based sensor, or pressure sensor.

In some embodiments, the in-ear headphone further includes control circuitry configured to process signals from the one or more ear presence sensors to detect when the earbud tip is located near or in the user's ear canal. In some embodiments, the one or more ear presence sensors are configured to detect when the earbud tip is located in the user's ear canal by measuring a pressure change in acoustic volume from when the earbud tip is not sealed against the user's ear canal to when the earbud tip is sealed against the user's ear canal. In some embodiments, the one or more light-based sensors are configured to detect when the earbud tip is located near the user's ear canal prior to the one or more ear presence sensors detecting when the earbud tip is located in the user's first ear canal. In certain embodiments, control circuitry is configured to at least one of activate media playback, resume media playback, restore volume level of media playback, or activate noise cancelling in response to the one or more ear presence sensors detecting that the earbud tip is located in the user's ear canal.

In some embodiments, the in-ear headphone further includes a second earbud, the second earbud including a housing, a speaker positioned within the housing, a conduit at least partially enclosed by the housing configured to direct audio signals provided by the speaker into a second ear canal of a user, and an earbud tip coupleable to a portion of the conduit and configured to seal the second ear canal of the user when positioned therein. The earbud tip includes an inner tube extending at least partially within an outer body of the earbud tip, the tube having opposing first and second ends and first and second openings at the opposing first and second ends, respectively. The first opening is configured to emit the audio signals provided by the speaker into the user's first ear canal and the second opening is configured to be removably coupled to the portion of the conduit. The earbud tip includes one or more channels extending from an outer periphery of the earbud tip to the inner tube.

In some embodiments an in-ear headphone is provided that includes first and second earbuds. The first earbud can include a first earbud housing, a first speaker positioned within the first earbud housing, a first conduit at least partially enclosed by the first earbud housing and configured to direct audio signals provided by the first speaker into a first ear canal of a user, and a first earbud tip coupleable to a portion of the first conduit and configured to seal the first ear canal of the user when positioned therein. The second earbud can include a second earbud housing, a second speaker positioned within the second earbud housing, a second conduit at least partially enclosed by the second earbud housing and configured to direct audio signals provided by the second speaker into a second ear canal of a user, and a second earbud tip coupleable to a portion of the second conduit and configured to seal the second ear canal of the user when positioned therein. Each of the first and second earbud tips can include an inner tube extending at least partially within an outer body of the earbud tip, the tube having opposing first and second ends and first and second openings at the opposing first and second ends, respectively. The first opening can be configured to emit the audio signals provided by the speaker into the user's ear canal and the second opening can be configured to be removably coupled to the portion of the first or second conduit, and the one or more channels can extend from an outer periphery of the earbud tip to the inner tube.

To better understand the nature and advantages of the present invention, reference should be made to the following description and the accompanying figures. It is to be understood, however, that each of the figures is provided for the purpose of illustration only and is not intended as a definition of the limits of the scope of the present invention. Also, as a general rule, and unless it is evident to the contrary from the description, where elements in different figures use identical reference numbers, the elements are generally either identical or at least similar in function or purpose.

DETAILED DESCRIPTION

Electronic device accessories such as in-ear headphones can be provided with ear presence (e.g., in-ear detection) capability or features. Such features can provide the in-ear headphones with the ability to sense the presence of external objects. For example, an in-ear headphone as described herein can be provided with ear presence sensors configured to determine whether or not the in-ear headphones are located near or in the ears (e.g., an ear canal) of a user.

Information gathered by the sensor structures can be used to control the operation of an electronic device such as a media player that is in wired or wireless communication with the accessory. For example, control circuitry in the accessory or in the electronic device can automatically activate or deactivate media playback or noise cancellation features based on whether or not the in-ear headphones are located near or in the ears of a user. Controlling media playback or noise cancellation features in a pair of headphones coupled (e.g., wired or wirelessly) to an electronic device based on whether or not the in-ear headphones are in the ears of a user (e.g., in the ear canal and ready for media playback or noise cancellation) can reduce power consumption and extend the battery life of the headphones and/or of the electronic device.

Figure 1:
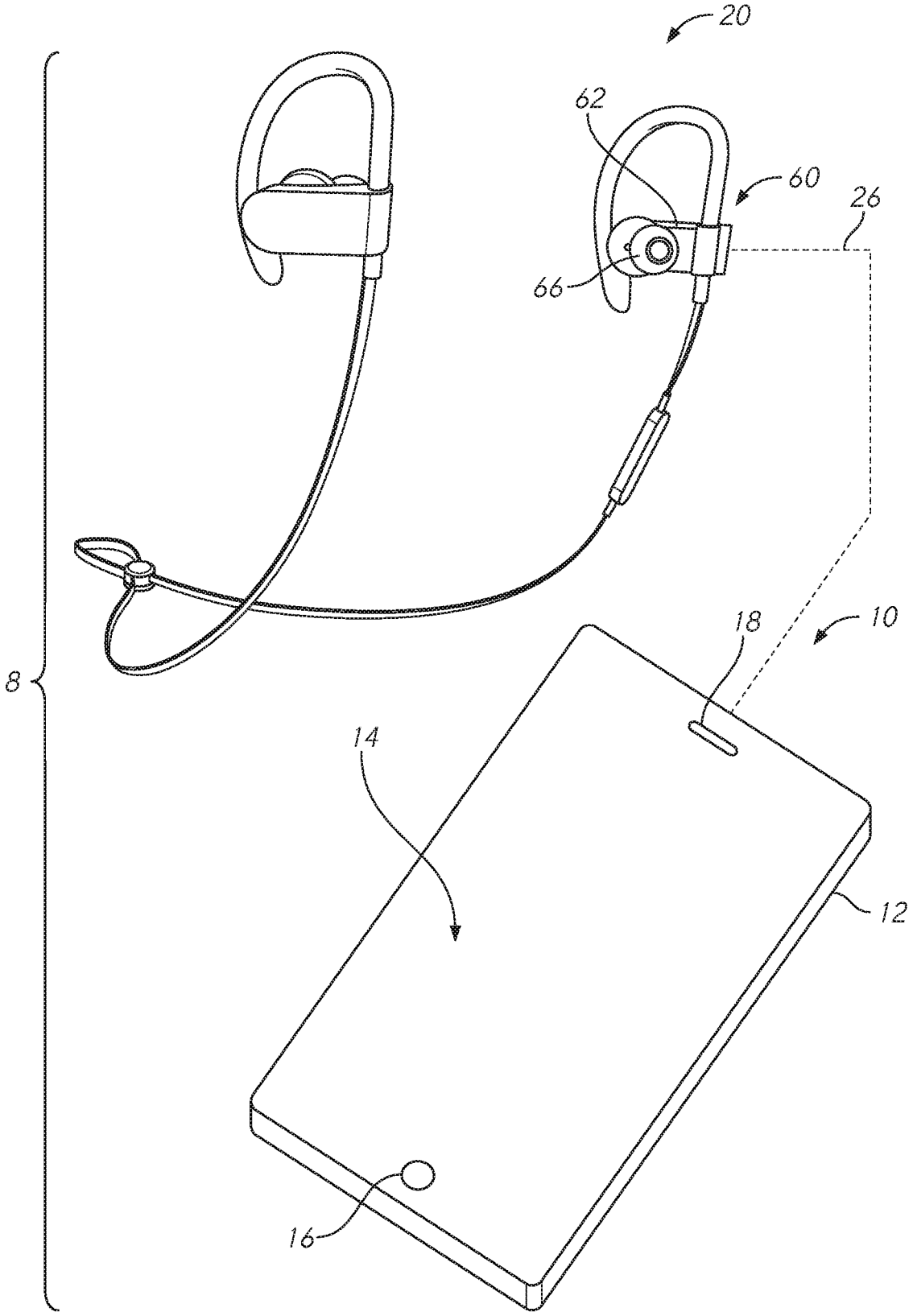
FIG. 1 illustrates an electronic device and associated accessory according to an embodiment of the present invention.

FIG. 1 is a diagram of a system of the type that can be provided with an accessory including ear presence sensors for detecting whether or not earbud tips of the in-ear headphones are located near or in the ears of a user. As shown in FIG. 1, system 8 can include electronic device 10 and accessory 20.

Electronic device 10 can include a display 14 and a housing 12. Display 14 can be a touch screen that incorporates a layer of conductive capacitive touch sensor electrodes or other touch sensor components or can be a display that is not touch-sensitive. Display 14 can include an array of display pixels formed from liquid crystal display (LCD) components, an array of electrophoretic display pixels, an array of plasma display pixels, an array of organic light-emitting diode display pixels, an array of electrowetting display pixels, or display pixels based on other display technologies. Housing 12, which can sometimes be referred to as an enclosure or case, can be formed of plastic, glass, ceramics, fiber composites, metal (e.g., stainless steel, aluminum, etc.), other suitable materials, or a combination of any two or more of these materials. The housing 12 can be monolithically formed or constructed with separate components. In some embodiments, electronic device 10 can include an input button 16 or speaker port 18.

As discussed above, accessory 20 can be an in-ear headphone that includes a pair of earbuds 60. As used herein, an "earbud" includes any small earphone that is designed to be worn on a user and fit within a user's outer ear facing the ear canal with a tip of the earbud being inserted into the ear canal. Each earbud includes a housing 62 and an earbud tip 66 configured to extend partially into a respective left or right ear canal of a user when in use or ready for use. In other embodiments, the accessory 20 can be other audio equipment (e.g., an audio device with a single earbud and earbud tip). The use of an in-ear headphone with a pair of earbuds 60 in system 8 is described herein as an illustrative example.

As shown in FIG. 1, a wired or wireless communications path (identified with broken lines 26) couples electronic device 10 and accessory 20. The communications path 26 can be used to route signals (e.g., audio signals) from device 10 to speakers in respective housing 62 of earbuds 60 as described in more detail below. Earbuds 60 (which can sometimes be referred to as speakers or earphone housings) can include sensor structures for determining when earbuds 60 (e.g., earbud tips 66) have been placed within or are inserted into the ear canals of a user as further described below.

Figure 2:
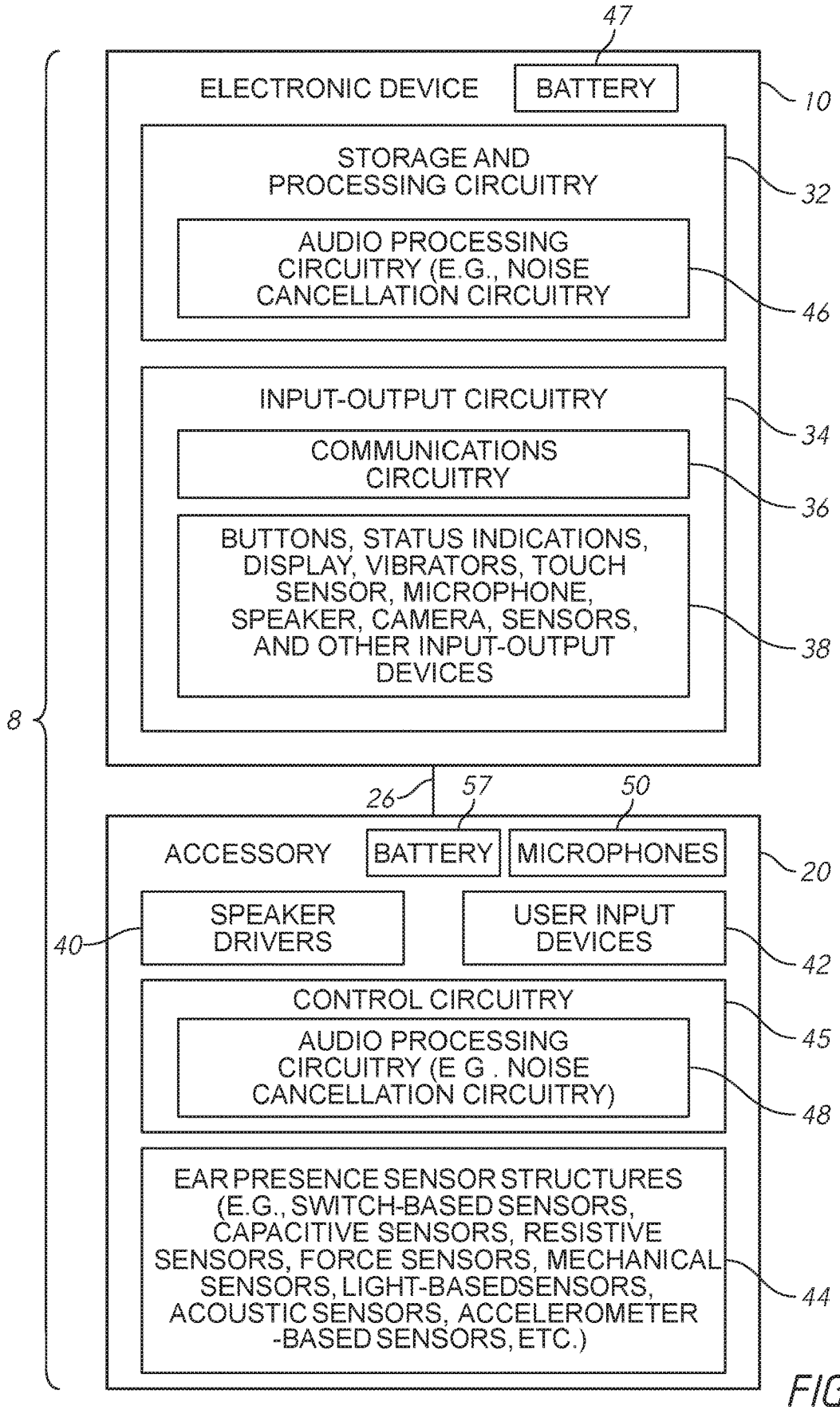
FIG. 2 illustrates a schematic diagram of electronic components of electronic device and associated accessory of FIG. 1 according to an embodiment of the present invention.

A schematic diagram showing illustrative components that can be used in device 10 and accessory 20 of system 8 is shown in FIG. 2. Electronic device 10 can include a power source (e.g., a battery 47) for powering the device. As shown in FIG. 2, electronic device 10 can include control circuitry 32 and input-output circuitry 34. Control circuitry 32 can include storage and processing circuitry that is configured to execute software that controls the operation of electronic device 10. Control circuitry 32 can be implemented using one or more integrated circuits such as microprocessors, application specific integrated circuits, memory, and other storage and processing circuitry. Control circuitry 32 can, if desired, include noise cancellation circuitry and other audio processing circuitry 46.

Input-output circuitry 34 can include components for receiving input from external equipment and for supplying output. For example, input-output circuitry 34 can include user interface components for providing a user of device 10 with output and for gathering input from a user. As shown in FIG. 2, input-output circuitry 34 can include communications circuitry 36. Communications circuitry 36 can include wireless circuitry such as radio-frequency transceiver circuitry with a radio-frequency receiver and/or a radio-frequency transmitter. Radio-frequency transceiver circuitry in the wireless circuitry can be used to handle wireless signals in communications bands such as the 2.4 GHz and 5 GHz WiFi® bands, cellular telephone bands, and other wireless communications frequencies of interest. Communications circuitry 36 can also include wired communications circuitry such as circuitry for communicating with external equipment over serial and/or parallel digital data paths.

Input-output devices 38 can include buttons such as sliding switches, push buttons, menu buttons, buttons based on dome switches, keys on a keypad or keyboard, or other switch-based structures. Input-output devices 38 can also include status indicator lights, vibrators, display touch sensors, speakers, microphones, camera sensors, ambient light sensors, proximity sensors, and other input-output structures.

Electronic device 10 can be coupled to components in accessory 20 with the wired or wireless communications path 26 as described above. Accessory 20 can include a power source such as a battery 57. Accessory 20 can include speakers such as a pair of speaker drivers 40 (e.g., a left speaker and a right speaker for each earbud 60). If desired, accessory 20 can include more than one driver per earbud 60. For example, each earbud 60 of accessory 20 can include a tweeter, a midrange driver, and a bass driver (as an example). Speaker drivers 40 can be mounted in earbud housings 62. The use of left and right earbuds to house respective left and right speaker drivers 40 is described herein as an example.

Accessory 20 can include control circuitry such as control circuitry 45. Control circuitry 45 can, for example, include storage and processing circuits formed from one or more integrated circuits or other circuitry. Circuitry 45 in accessory 20 can include noise cancellation circuitry and other audio processing circuitry 48, if desired. In some embodiments, the communications path 26 can be used to transmit audio from circuitry 32 to speaker drivers 40 during playback operations.

Accessory 20 can include user input devices 42 such as buttons, touch-based input devices (e.g., touch screens, touch pads, touch buttons), one or more microphones 50 (e.g., a microphone to gather voice input, other microphones such as noise cancellation microphones), and other user input devices.

To determine whether or not the earbuds 60 or specifically the earbud tips 66 are located in or near the ears (e.g., ear canals) of a user, accessory 20 can be provided with one or more ear presence sensors 44. Ear presence sensors 44 can be configured to detect whether or not the earbud 60 or specifically the earbud tips 66 are present near or in the ears of a user. Ear presence sensors can be formed from pressure sensors or transducers (e.g., one of microphones 50), from force sensors, from switches or other mechanical sensors, from capacitive sensors, from resistance-based sensors, from light-based sensors, from accelerometer-based sensors, and from acoustic-based sensors such as ultrasonic acoustic-based sensors (as examples).

Control circuitry 45 in accessory 20 and/or control circuitry 32 of electronic device 10 can use information from ear presence sensors 44 in determining which actions (e.g., activate media playback, resume media playback, restore volume level of media playback, activate noise cancelling, deactivate, pause, stop, minimize volume, or deactivate noise cancelling) should be automatically taken by device 10 and/or by accessory 20. The accessory 20 can be provided with a plurality of same or different ear presence sensors 44.

Figure 3:
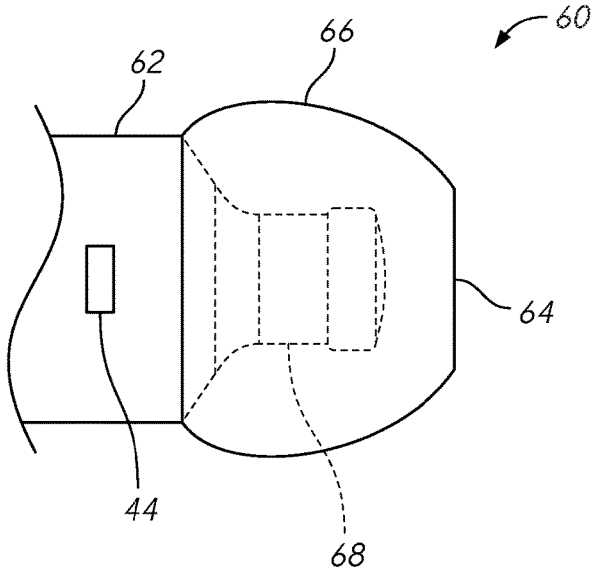
FIG. 3 illustrates a portion of accessory of FIG. 1 including an eartip bud according to an embodiment of the present invention.
Figure 4A:
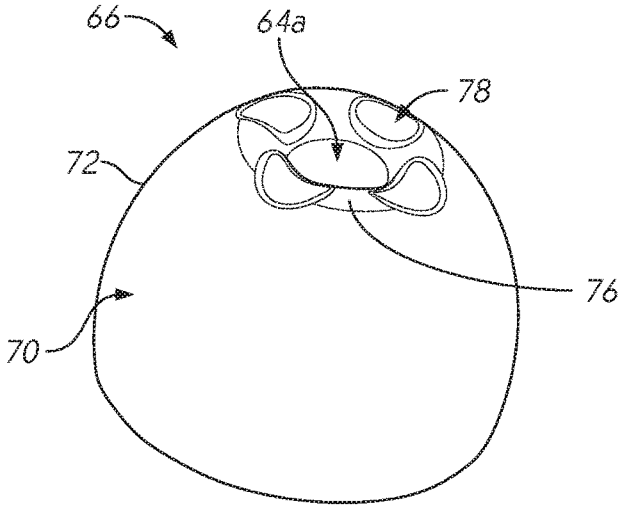
FIGS. 4A-4B illustrates close-up views of the eartip bud of FIG. 3 according to an embodiment of the present invention.
Figure 4B:
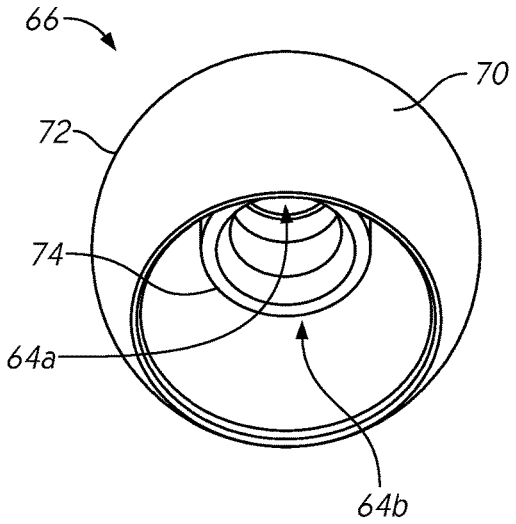

With reference to FIG. 3 and FIGS. 4A-4B, the earbud tip 66 of a first earbud 60 that can be provided with the accessory 20 is illustrated. While referring to a first earbud 60, identical features can be provided with a second earbud 60. The housing 62 of the first earbud 60 can enclose the components (e.g., speaker driver 40) of the accessory 20 described above. The first earbud 60 includes a conduit 68 (e.g., an acoustic or audio channel) configured to direct audio signals provided by the speaker driver 40 into an ear canal of a user. The conduit 68 can be partially or entirely enclosed by the housing 62 and extend therefrom. The conduit 68 can be separately or monolithically formed with the housing 62. The removable earbud tip 66 is coupleable to a portion of the conduit 68 and includes an opening 64 configured to emit the audio signals provided by the speaker drive 40 into the user's ear canal. The first earbud can include one or more ear presence sensors 44 as described above. The ear presence sensors 44 can be disposed on a portion of housing 62, earbud tip 66, or both.

As illustrated in front and rear perspective views of FIGS. 4A-4B, the earbud tip 66 includes an inner tube 74 extending at least partially within an outer body 70 of the earbud tip 66. While illustrated as having a generally dome-shaped configuration, the earbud tip 66 can have any suitable configuration (e.g., bulb, circular). The inner tube 74 has opposing first and second ends and first and second openings 64*a* and 64*b* at the opposing first and second ends, respectively. The first opening 64*a* is configured to emit the audio signals provided by the speaker driver 40 into the user's ear canal and the second opening 64*b* is configured to be removably coupled to at least a portion of the conduit 68. In some embodiments, the earbud tip 66 can entirely enclose the conduit 68 when coupled thereto.

Figure 7:
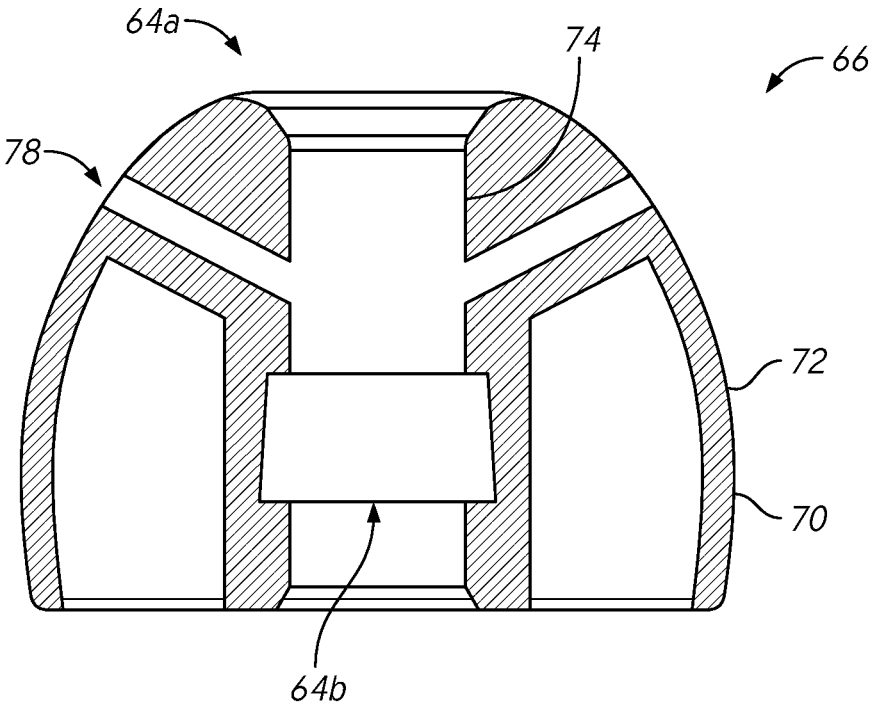
FIG. 7 illustrates an eartip bud according to another embodiment of the present invention.

The earbud tip 66 further includes one or more channels 78 (e.g., grooves, dimples, recesses, divots, depressions) extending from an outer periphery 72 of the earbud tip 66 to the inner tube 74. The channels 78 can prevent or reduce a potential of unintentionally sealing the earbud tip 66 (e.g., outside a user's ear canal). As such, in-ear detection based on pressure change in acoustic volume detected or measured by one or more ear presence sensors 44 is less likely to be falsely triggered by the earbud tip 66 sealing against surfaces outside the user's ear canal, as described in more detail below. As shown in FIG. 4A, the one or more channels 78 can extend across a top or front face or surface (e.g., lip, edge, rim) of earbud tip 66 from the outer periphery 72 to the first opening 64*a*. In this manner, each channel 78 forms a valley between adjacent peaks (i.e., the most distal portions of top surface 76 of earbud tip 66) disposed around first opening 64*a*. The channels 78 can be disposed radially about and extend outwardly from first opening 64*a*. In other embodiments, the channels 78 can be vents extending from the outer periphery 72 to the inner tube 74 between top and bottom surfaces of the earbud tip 66 (see FIG. 7).

Figure 5:
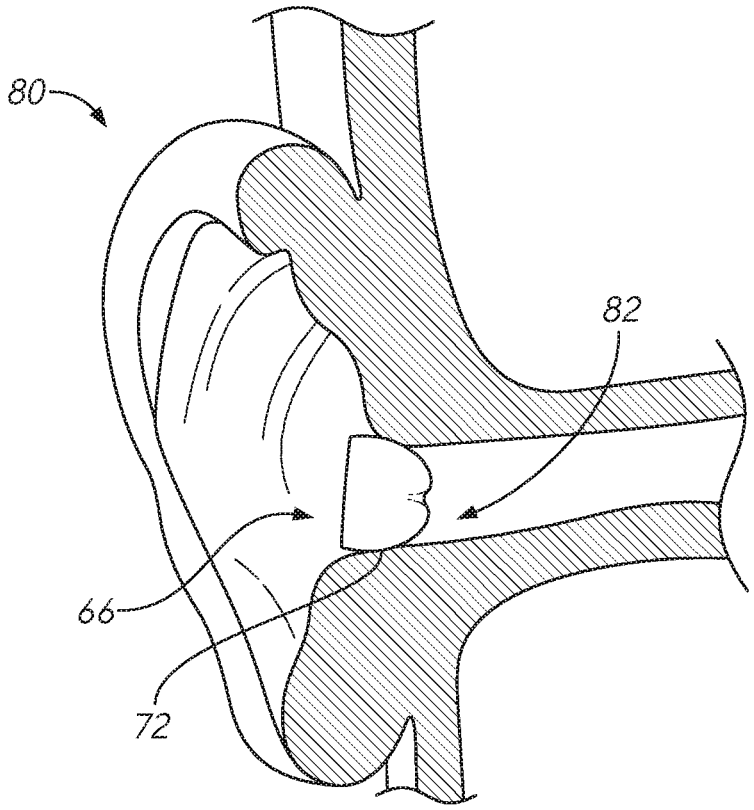
FIG. 5 illustrates the eartip bud of FIG. 3 positioned within an ear canal of a user according to an embodiment of the present invention.

As shown in FIG. 5, when the earbud tip 66 is inserted into the ear canal 82 of a user 80, the outer periphery 72 seals against an inner wall of the ear canal. The earbud tips 66 can be made from a compliant material (e.g., rubber) such that the tips can fit within and conform in shape to the user's ear canal 82. When sealed against the inner wall of the ear canal, first opening 64*a* is disposed entirely within the ear canal 82. An ear presence sensor 44 such as a pressure transducer (e.g., a microphone 50, piezoelectric transducer) can be used to detect pressure change (e.g., increase in positive pressure) in acoustic volume from when the earbud tip 66 is unsealed (e.g., positioned out of the ear canal 82) and sealed within the ear canal 82. For example, a pressure change in acoustic volume in audio signals sent by speaker driver 40 when the earbud tip 66 is unsealed (e.g., positioned out of the ear canal 82) and sealed within the ear canal 82 can be detected by the ear presence sensor. Control circuitry 45 in accessory 20 and/or control circuitry 32 of electronic device 10 can then use the information from the ear presence sensor (e.g., pressure change in acoustic volume or measurements) in determining which actions should be automatically taken by device 10 and/or by accessory 20 (e.g., activate media playback, resume media playback, restore volume level of media playback, or activate noise cancelling) if the pressure change in acoustic volume indicates the earbud tip 66 is sealed within the ear canal 82 or if the earbud tip is not sealed within the ear canal 82 (e.g., deactivate, pause, or stop media playback, minimize volume, or deactivate noise cancelling). First earbud 60 can be provided with multiple pressure transducers with various sensitivities for detecting different ranges of pressure changes in acoustic volume.

Figure 6:
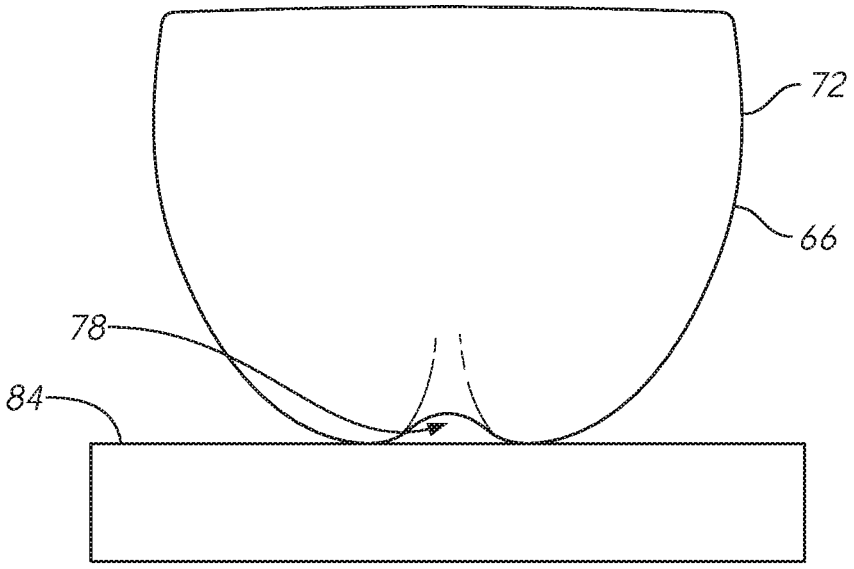
FIG. 6 illustrates the eartip bud of FIG. 3 with a tip disposed on a planar surface according to an embodiment of the present invention.

As shown in FIG. 6, the one or more channels 78 are configured to prevent or reduce unintentional sealing of the earbud tip 66 (e.g., first opening 64*a*) outside the ear canal 82. When the top or front surface is seated on or against a plane or planar surface 84 (e.g., a tabletop, desk, ground), the channels 78 provide a gap between the distal surface of earbud tip 66 (i.e., top surface 76 shown in FIG. 4A) and the surface 84 such that the first opening 64*a* is not sealed against or substantially occluded by the surface 84. Thus, the ear presence sensors 44 will not be falsely triggered by a substantive pressure change in acoustic volume when the top or front surface is seated on or against the planar surface 84. Similarly, the channels 78 can provide a gap between the top surface 76 or prevent occluding of the first opening 64*a* of the earbud tip 66 by a user's hand or finger resting on the top surface 76 without substantially deformation. Additionally, the channels 78 can provide a gap or opening between the top surface 76 of the earbud tip when positioned within a bag or user's clothing (e.g., pocket) to prevent or reduce false in-ear detection by the ear presence sensors 44 due to sealing or occluding the first opening 64*a*.

As discussed above, the earbuds of the accessory 20 can include other ear presence sensors 44 or a combination of other sensors such as light-based sensors (e.g., optical sensors) or accelerometer-based sensors. These other sensors can be used to determine whether to activate the pressure sensor. For example, the other sensors can be used to determine whether the earbud 60 is near or proximate a user's ear prior to enabling the in-ear detect sensing by the pressure sensor. If so, then the pressure sensor can be activated to detect whether the earbud tip 66 is sealed against or within the user's ear canal. Including additional sensors for sensing whether the earbud 60 is near or proximate the user's ear canal prior to enabling or activating the pressure sensor can further reduce or prevent false triggers as well as minimize or reduced power consumption by the ear presence sensors.

From the foregoing, it will be appreciated that specific embodiments of the invention have been described herein for purposes of illustration, but that various modifications can be made without deviating from the spirit and scope of the various embodiments of the invention. For example, while one specific configuration of an in-ear headphone is depicted in FIG. 1, embodiments of the disclosure are not limited to such a specific implementation. In other embodiments, earbud tips according to the disclosure can be used with in-ear headphones having configurations quite different from that of earbuds 60. As one example, in some embodiments, in-ear headphones according to the disclosure can be completely wireless and include first and second earbuds that are not connected to each other with a cable, wire or similar tethering device and that do not include loops, hooks, or other structures to secure the earbuds over a user's ear. As further example, an earbud according to the disclosure can include a housing having an in-ear portion integrally formed with a stem portion that extends away from the in-ear portion away from the user's ear canal. A speaker can be housed within the in-ear housing portion which can further include a channel or nozzle (similar to conduit 68) that directs audio signals from the speaker towards a user's ear canal. An earbud tip, as disclosed herein, can be coupled to the channel/nozzle to enable the earbud to be inserted within the user's ear canal. A microphone can be positioned at or near an end of the stem portion such that the microphone is closer to the user's mouth. Various other components of the in-ear headphone, such as a wireless antenna, wireless circuitry, battery, battery charging circuitry, audio processing circuitry, a microphone and the like, can be disposed within the housing in either the in-ear portion or the stem portion. Further, while various advantages associated with certain embodiments of the invention have been described above in the context of those embodiments, other embodiments can also exhibit such advantages, and not all embodiments need necessarily exhibit such advantages to fall within the scope of the invention. Accordingly, the invention is not limited, except as by the appended claims.

References throughout the foregoing description to features, advantages, or similar language do not imply that all of the features and advantages that can be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification can, but do not necessarily, refer to the same embodiment. Also, it is well understood that the use of personally identifiable information should follow privacy policies and practices that are generally recognized as meeting or exceeding industry or governmental requirements for maintaining the privacy of users. In particular, personally identifiable information data should be managed and handled so as to minimize risks of unintentional or unauthorized access or use, and the nature of authorized use should be clearly indicated to users.

Furthermore, the described features, advantages, and characteristics of the present invention can be combined in any suitable manner in one or more embodiments. One skilled in the relevant art will recognize that the present invention can be practiced without one or more of the specific features or advantages of a particular embodiment. In other instances, additional features and advantages can be recognized in certain embodiments but may not be present in all embodiments of the present invention.

Where the context permits, words in the above Detailed Description using the singular or plural number can also include the plural or singular number respectively. The word "or," in reference to a list of two or more items, covers all of the following interpretations of the word: any of the items in the list, all of the items in the list, and any combination of the items in the list.

Additionally, spatially relative terms, such as "bottom or "top" and the like can be used to describe an element and/or feature's relationship to another element(s) and/or feature(s) as, for example, illustrated in the figures. It will be understood that the spatially relative terms are intended to encompass different orientations of the device in use and/or operation in addition to the orientation depicted in the figures. For example, if the device in the figures is turned over, elements described as a "bottom" surface can then be oriented "above" other elements or features. The device can be otherwise oriented (e.g., rotated 90 degrees or at other orientations) and the spatially relative descriptors used herein interpreted accordingly.

What is claimed is:

1. An earbud tip for an in-ear headphone, the earbud tip comprising:

an outer body;

an inner tube extending at least partially within the outer body, the tube having opposing first and second ends and first and second openings at the opposing first and second ends, respectively, the first opening at an exterior surface of the outer body enabling audio signals provided by a speaker of an in-ear headphone to be directed into a user's ear canal during operation of the in-ear headphone and the second opening configured to be removably coupled to a portion of the in-ear headphone; and wherein an exterior surface of the outer body includes a plurality of peaks and valleys disposed radially around the first opening at a distal end of the outer body and wherein, when the earbud tip is inserted in a user's ear canal, the outer body creates a seal within the ear canal that creates a pressure change in acoustic volume when audio signals are delivered through the earbud tip to the user's ear.

2. The earbud tip of claim 1 wherein each of the plurality of valleys is part of a channel extending from the first opening across a portion of the distal end of the outer body.

3. The earbud tip of claim 1 wherein the plurality of peaks and valleys comprise at least one or more grooves, divots or dimples formed in the outer body.

4. The earbud tip of claim 1 wherein the plurality of valleys in the exterior surface of the outer body extend across an outer surface of the earbud tip from an outer periphery to the first opening of the earbud tip.

5. The earbud tip of claim 1 wherein the plurality of peaks and valleys are formed on a rim of the earbud tip extending circumferentially around the first opening.

6. The earbud tip of claim 1 wherein the plurality of peaks and valleys disposed radially around the first opening are configured to deter unintentional sealing of the earbud tip against a planar surface outside the ear canal or clothing of a user.

7. An in-ear headphone comprising:

an earbud housing, a speaker positioned within the earbud housing, a conduit at least partially enclosed by the earbud housing configured to direct audio signals provided by the speaker into an ear canal of a user, and an earbud tip coupleable to a portion of the conduit and configured to seal the ear canal of the user when positioned therein, the earbud tip comprising:

an inner tube extending at least partially within an outer body of the earbud tip, the tube having opposing first and second ends and first and second openings at the opposing first and second ends, respectively, the first opening enabling audio signals provided by the speaker to be directed into the user's ear canal and the second opening configured to be removably coupled to the portion of the conduit; and one or more channels extending from an outer periphery of the earbud tip to the inner tube body;

wherein, when the earbud tip is inserted in a user's ear canal, the outer body creates a seal within the ear canal that creates a pressure change in acoustic volume when audio signals are delivered through the earbud tip to the user's ear.

8. The in-ear headphone of claim 7 wherein the one or more channels comprise one or more vents extending through the outer periphery of the earbud tip and in fluid communication with the inner tube.

9. The in-ear headphone of claim 7 wherein the one or more channels comprise at least one or more grooves, divots, depressions, recesses, or dimples.

10. The in-ear headphone of claim 7 wherein the one or more channels extend across a top surface of the earbud tip from the outer periphery to the first opening of the earbud tip.

11. The in-ear headphone of claim 7 wherein the one or more channels are formed on a rim of the earbud tip extending circumferentially around the first opening.

12. The in-ear headphone of claim 7 wherein the one or more channels are configured to deter unintentional sealing of the earbud tip against a planar surface outside the ear canal.

13. The in-ear headphone of claim 7 wherein the one or more channels are configured to deter unintentional sealing of the earbud tip against clothing of the user.

14. The in-ear headphone of claim 7 wherein comprising one or more ear presence sensors configured to detect when the earbud tip is located near or in the user's ear canal.

15. The in-ear headphone of claim 14 wherein the one or more ear presence sensors comprise at least one of a force sensor, mechanical sensor, capacitive sensor, resistance-based sensor, light-based sensor, accelerometer-based sensor, acoustic-based sensor, or pressure sensor.

16. The in-ear headphone of claim 14 further comprising control circuitry configured to process signals from the one or more ear presence sensors to detect when the earbud tip is located near or in the user's ear canal.

17. The in-ear headphone of claim 14 wherein the one or more ear presence sensors are configured to detect when the earbud tip is located in the user's ear canal by measuring a pressure change in acoustic volume from when the earbud tip is not sealed against the user's ear canal to when the earbud tip is sealed against the user's ear canal.

18. The in-ear headphone of claim 17 further comprising one or more light-based sensors configured to detect when the earbud tip is located near the user's ear canal prior to the one or more ear presence sensors detecting when the earbud tip is located in the user's ear canal.

19. The in-ear headphone of claim 17 further comprising control circuitry configured to at least one of activate media playback, resume media playback, restore volume level of media playback, or activate noise cancelling in response to the one or more ear presence sensors detecting that the earbud tip is located in the user's ear canal.

20. An earbud tip for an in-ear headphone, the earbud tip comprising:

an outer body;

an inner tube extending at least partially within the outer body, the tube having opposing first and second ends and first and second openings at the opposing first and second ends, respectively, the first opening configured to emit enabling audio signals provided by a speaker of an in-ear headphone to be directed into a user's ear canal during operation of the in-ear headphone and when the earbud tip seals the user's ear canal and the second opening configured to be removably coupled to a portion of the in-ear headphone; and one or more channels arranged radially around the first opening and extending through an outer periphery of the earbud tip to the inner tube;

wherein, when the earbud tip is inserted in a user's ear canal, the outer body creates a seal within the ear canal that creates a pressure change in acoustic volume when audio signals are delivered through the earbud tip to the user's ear.

21. An earbud tip for an in-ear headphone, the earbud tip comprising:

a deformable outer body;

an inner tube extending at least partially within the deformable outer body, the tube having opposing first and second ends and first and second openings at the opposing first and second ends, respectively, the first opening enabling audio signals provided by a speaker of an in-ear headphone to be directed into a user's ear canal during operation of the in-ear headphone and the second opening configured to be removably coupled to a portion of the in-ear headphone; and wherein an exterior surface of the deformable outer body is a continuous surface surrounding the first opening and extending along a curve towards the second opening to an end of the deformable body, and wherein a plurality of peaks and valleys are formed in the continuous surface and radially disposed around the first opening.

* * * * *